US007281643B2

(12) United States Patent
Lin

(10) Patent No.: US 7,281,643 B2
(45) Date of Patent: Oct. 16, 2007

(54) AUTOMATIC SOAP DISPENSER STRUCTURE

(76) Inventor: Po-Hui Lin, No. 9, Lane 96, Sec. 2, Ho-Ping East Road, Taipei (TW)

( * ) Notice: Subject to any disclaimer, the term of this patent is extended or adjusted under 35 U.S.C. 154(b) by 322 days.

(21) Appl. No.: 11/151,411

(22) Filed: Jun. 14, 2005

(65) Prior Publication Data

US 2006/0278659 A1 Dec. 14, 2006

(51) Int. Cl.
*G01F 37/00* (2006.01)

(52) U.S. Cl. ..... 222/214; 222/333

(58) Field of Classification Search ..... 222/214, 222/333, 181.3

See application file for complete search history.

(56) References Cited

U.S. PATENT DOCUMENTS 5,492,247 A * 2/1996 Shu et al. ..... 222/214
5,611,465 A * 3/1997 Lee et al. ..... 222/214
6,036,056 A * 3/2000 Lee et al. ..... 222/333

* cited by examiner

*Primary Examiner*—Philippe Derakshani
(74) *Attorney, Agent, or Firm*—Rosenberg, Klein & Lee

(57) ABSTRACT

An improved automatic soap dispenser structure includes a motor and a gear wheel module installed in a driving device of a soap dispenser to transmit a driving wheel and uses an eccentric wheel disposed on the driving wheel to produce an eccentric effect, characterized in that the eccentric wheel couples a link member, and the link member presses a press plate, such that when the press plate compresses a soap dispensing tube, a back plate of the press plate and a latch surface of a rear panel compress to close the upper section of the soap dispensing tube, and then the design of a protruded curved surface of the press plate and a recessed curved surface of the rear panel compress the soap dispensing tube progressively downward to produce a power-saving and smooth compressing effect.

3 Claims, 12 Drawing Sheets

AUTOMATIC SOAP DISPENSER STRUCTURE

BACKGROUND OF THE INVENTION

1. Field of the Invention

This invention relates an improved automatic soap dispenser structure, and more particularly to an improved soap dispenser structure having an automatic sensor for providing liquid soap, and an appropriate quantity of the liquid soap can be squeezed out from the dispenser by a power-saving driving mechanism.

2. Description of the Related Art

The design of a soap dispenser is generally adopted and extensively used in public places for users to clean their hands, and the structure of a prior art soap dispenser usually includes a housing containing a bag of liquid soap, and one end of the bag is connected to an appropriate flexible soap dispensing tube. The soap dispensing tube adopts the design of a one-way check valve, and thus the liquid soap can be squeezed out in one direction and its backflow to the bag body can be prevented. The prior art automatic soap dispensers use a dry cell for supplying power to the dispenser and an optoelectronic infrared sensor for detecting the use conditions, so that a driving device drives the press plate to squeeze the soap dispensing tube and provide an appropriate quantity of liquid soap.

Most press plates take a flat linear shape and a user can start squeezing the middle section of the soap dispensing tube. If the middle section of the soap dispensing tube is squeezed and pressed, the liquid soap in the soap dispensing tube will flow upward and downward at the same time. Since the liquid soap at the upper section of the soap dispensing tube still has a counterforce remained, therefore the automatic soap dispenser requires a larger pressing and squeezing force to press the press plate to a predetermined position. If following one discharge cycle of the quantity of soap dispensed is insufficient, then the user will need to permit the automatic soap dispenser to complete one or more additional cycles in order to obtain sufficient liquid soap.

In the prior arts as disclosed in U.S. Pat. No. 6,347,724, some manufacturers install additional components, and these additional components are used together with the soap dispenser so that a user can pinch off the uppermost section of the extrusion tube, and then use the press plate to press and squeeze the middle section of the soap dispensing tube. Although such arrangement can provide sufficient liquid soap for users in one operation, the increased number of control components makes the manufacturing and assembling cost much higher. Further, although the prior art adopts the eccentric wheel, the prior art eccentric wheel is a component using a single force applying force, and some designs even require electric power for their applications which may increase the failure rate.

To overcome the existing shortcomings of the prior art products and make their application more convenient and practical, the inventor of the present invention based on years of experience in related areas and aimed at the foregoing shortcomings to conduct researches and developments and maximize the practicability of the present invention, and finally invented an improved automatic soap dispenser structure.

SUMMARY OF THE INVENTION

The primary objective of this invention is to provide an improved automatic soap dispenser structure that includes a motor and a gear wheel module installed in a driving device of a soap dispenser to drive a driving wheel and uses an eccentric wheel disposed on the driving wheel to produce an eccentric effect. The invention is characterized in that the eccentric wheel couples a link member, and the link member presses a press plate, and a back plate is protruded from the top of an external side of the press plate, and a slightly protruded curved surface is disposed at the middle section and the lower section of an external surface of the press plate.

Further, the rear panel corresponds to the press plate, and a latch surface, and a latch surface is protruded from the top of a lateral side, and a slightly recessive curved surface is disposed at the middle section and the lower section of an external side of the rear panel; such that when the press plate compresses a soap dispensing tube, the back plate of the press plate and the latch surface of the rear panel compress to close the upper section of the soap dispensing tube. Since the back plate is propped onto the top of the latch surface, so that the back plate becomes an axle center. If the press plate continues squeezing the soap dispensing tube, the back plate presses and squeezes the upper end of the soap dispensing tube to form a close status and also can maintain the previous pressing and squeezing effect without using additional squeezing force. The curvature and angle of the curved surface of the back plate and the curved surface of the press plate are skillfully designed in a way corresponding to each other to achieve a discharge cycle from the upper end to the lower end of the soap dispensing tube in a fast, power-saving and smooth manner, and then the design of a protruded curved surface of the press plate and a recessed curved surface of the rear panel compress the soap dispensing tube progressively downward. As a result, the liquid soap in the whole liquid supplying tube can be compressed and squeezed out in a single compressing routine, and thus producing a power-saving and smooth compressing effect and improving the applicability of the products.

Other features and advantages of the present invention will become apparent in the following detailed description of the preferred embodiments with reference to the accompanying drawings.

Referring to FIGS. 1 to 4, the improved automatic soap dispenser structure of the present invention comprises a casing 11, a chassis 12, a liquid soap container 13 and a squeeze control box 2; wherein:

The casing 11 is a hollow housing and has a rear panel 3 protruded from the internal bottom of said hollow housing, and the rear panel 3 has a latch surface 31 protruded from the upper section of the rear panel 3, a slightly recessive curved surface 32 disposed at the middle and lower section of the rear panel 3, and a flange 33 disposed at the bottom of the rear panel 3.

The chassis latches and covers the rear of the casing.

The liquid soap container 13 is a rectangular box and has a liquid soap bag for storing an appropriate quantity of liquid soap, and has an appropriate flexible soap dispensing tube 14 disposed at the bottom of a side of the liquid soap container 13 and the liquid soap container 13 is disposed at the upper section between the casing and the chassis.

Referring to FIG. 5 for the squeeze control box 2, a containing box 21 of the squeeze control box 2 is a rectangular box and has two partitions 22 disposed therein for partitioning the containing box 21 into three containing spaces, wherein the left and right containing spaces are provided for containing a battery module (not shown in FIG. 5), and the middle space is provided for containing a press plate 4, a driving device 4 and a link member 7, and the two partitions 22 separately include a penetrating circular hole 23 disposed at the top of an external side of the containing box 21.

Referring to FIGS. 5, and 7, the press plate 4 has an axle 41 protruded outward from both sides, a back plate 42 protruded from the upper side, and a slightly protruded curved surface 43 at the external sides of the middle section and the lower section of the press plate. Further, the lower section of the press plate 4 includes a penetrating circular hole 44, and the press plate 4 includes two axles 41 axially connected to the circular holes 23 of the two partitions 22 in the containing box 21.

Referring to FIGS. 5 and 6, the driving device 5 is a fixed plate 51 having a plurality of branch axles 541, 561, 64 for positioning the gear wheel modules. The motor 52 is mounted onto the fixed plate 51 by two screws 58 motor 52, and the motor 52 coaxially drives a small gear wheel 53 to transmit a large gear wheel 54 and then a small gear wheel 55 coaxially connected to the large gear wheel 54 transmits another large gear wheel 56, such that a small gear wheel 57 coaxially coupled with the large gear wheel 56 and a driving wheel 6 are engaged with each other. The driving device 5 is installed in the middle of the containing box 21 by the fixed plate 51, and a cycle completion switch 8 is connected on the fixed plate 51 proximate to the branch axle 64.

The driving wheel 6 has an eccentric wheel 61 protruded from a side, and a small cylindrical rod 63 protruded from another side, and the small cylindrical rod 63 presses on the cycle completion switch 8 on the fixed plate 51 by the rotation of the driving wheel 6 to control and stop the motor. The driving wheel 6 includes a branch axle 64 of the fixed plate 51 axially coupled to the center of the circular hole 62.

Referring to FIGS. 5 to 7 for the link member 7, the link member 7 has a penetrating circular hole 71 axially coupled to an eccentric wheel 61 disposed on one side of the driving wheel 6, and a casing pipe 72 protruded from another side. The casing pipe 72 has a penetrating circular hole 73 at the center, and the link member 7 pivotally connects the link member 7 and the press plate 4 by an axle rod 45, the circular hole 44 of the press plate 4, and the circular hole 73 of the casing pipe 72 of the link member 7.

In the present invention, the containing box 21 of the squeeze control box 2 is fixed at the bottom of the chassis 12 and the liquid soap container 13 is disposed at the top of the containing box. The soap dispensing tube 14 is latched to the external side of the press plate 4, and the partitions 22 of the containing box 21 install a battery module 24 each on both sides, such that the soap dispensing tube 14 is installed between the rear panel 3 and the press plate 4. The casing 11 and the chassis 12 are combined to define the improved automatic soap dispenser structure.

DETAILED DESCRIPTION OF THE PREFERRED EMBODIMENTS

To make it easier for our examiner to understand the objective of the invention, its structure, innovative features, and performance, we use a preferred embodiment together with the attached drawings for the detailed description of the invention.

Figure 1:
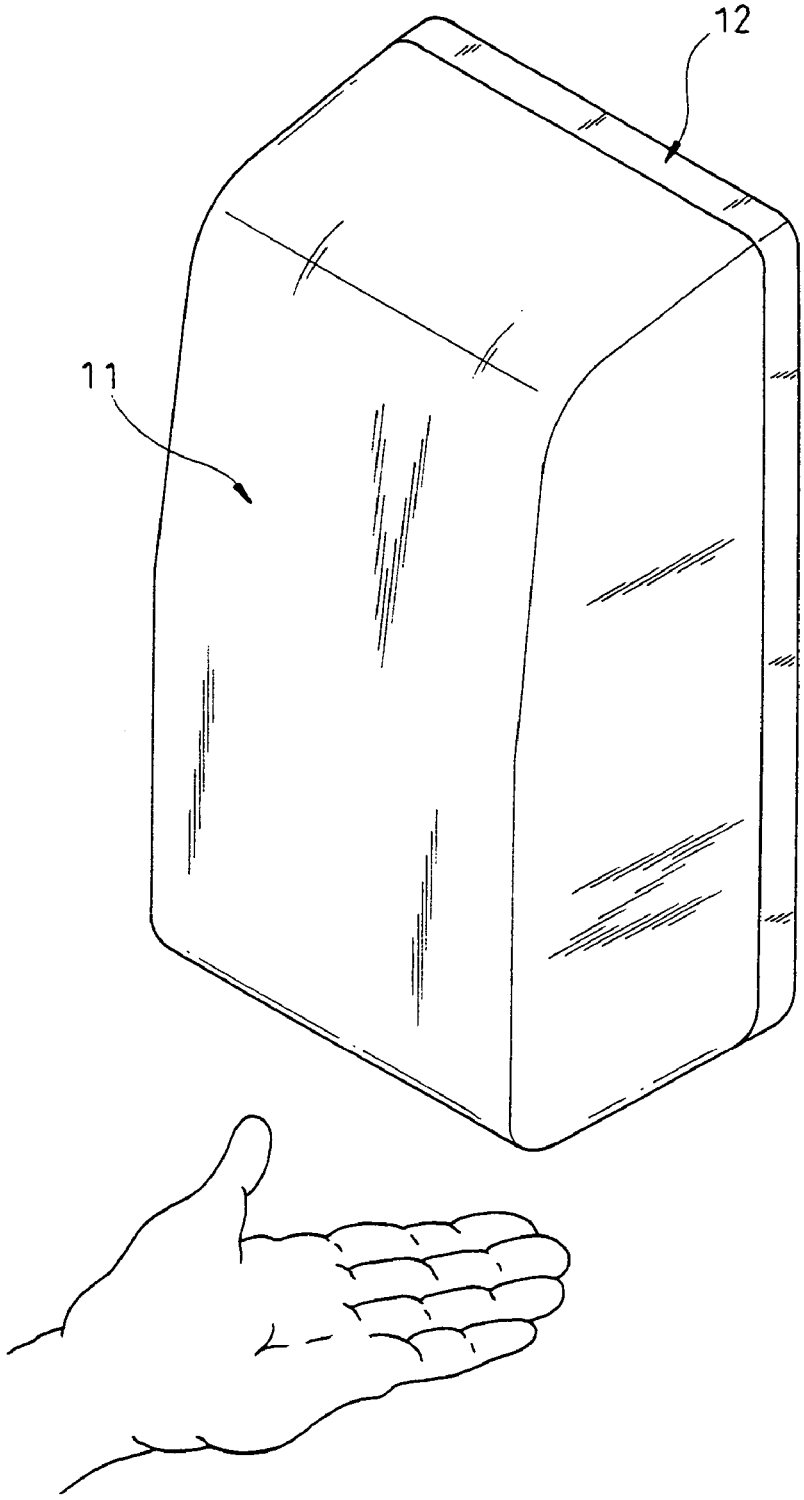
FIG. 1 is a perspective view of the present invention.
Figure 2:
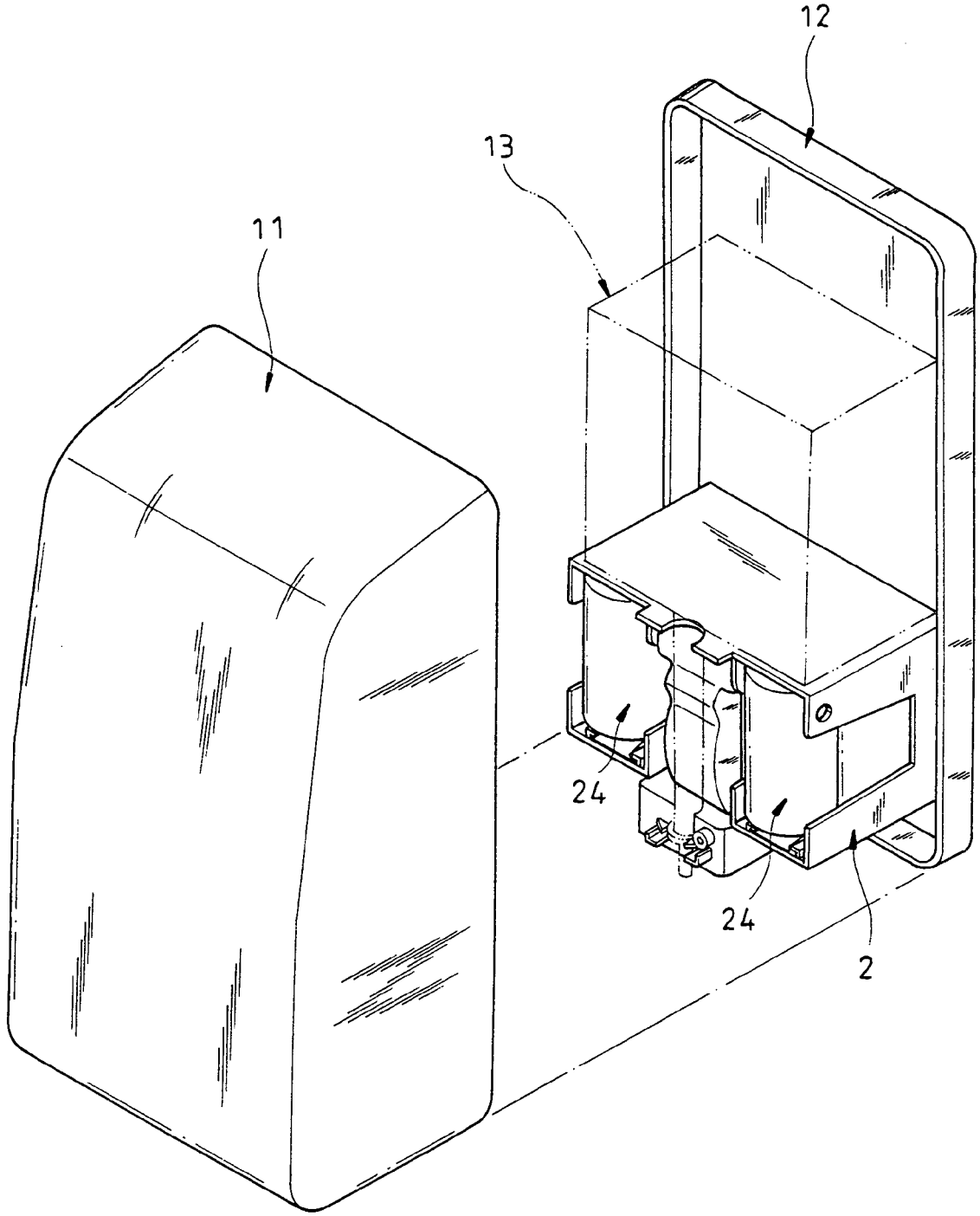
FIG. 2 is an exploded view of the present invention.
Figure 3:
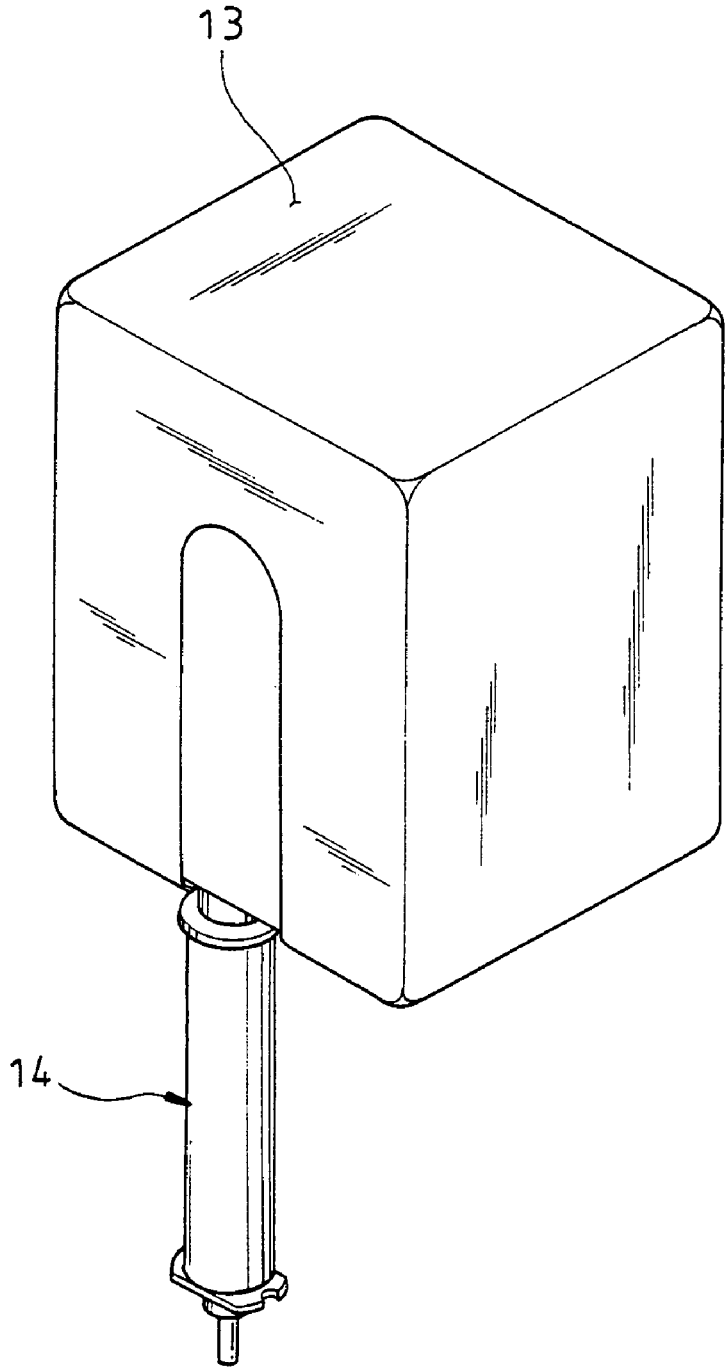
FIG. 3 is a schematic view of a liquid soap container of the present invention.
Figure 4:
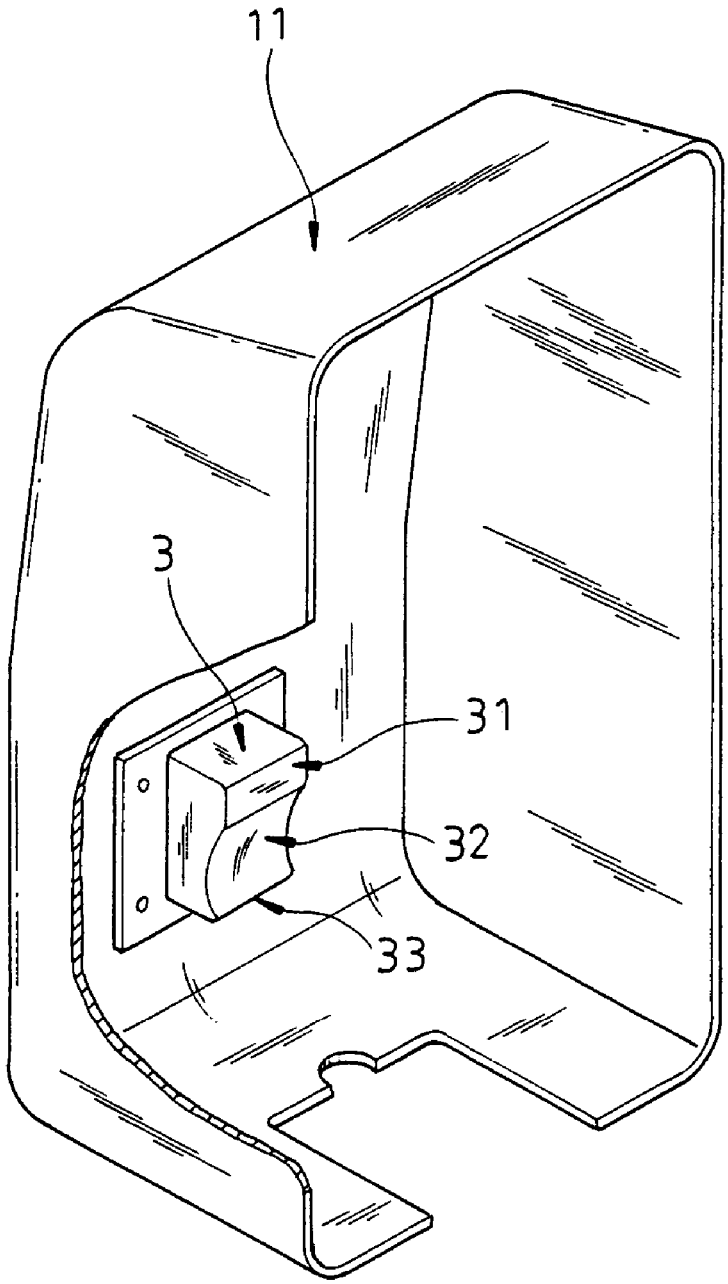
FIG. 4 is a schematic view of a rear panel of the present invention.
Figure 5:
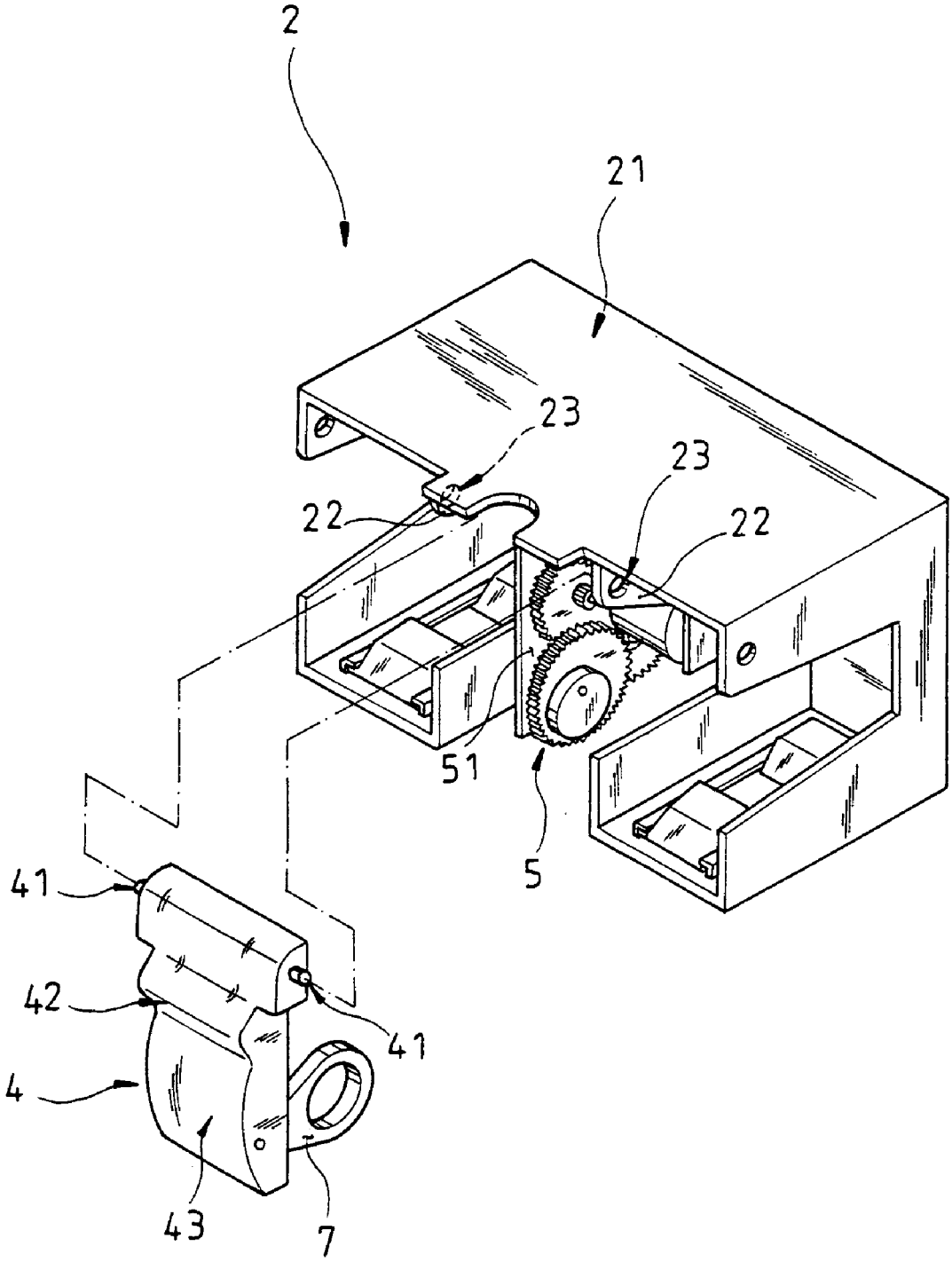
FIG. 5 is a schematic view of a squeeze control box of the present invention.
Figure 6:
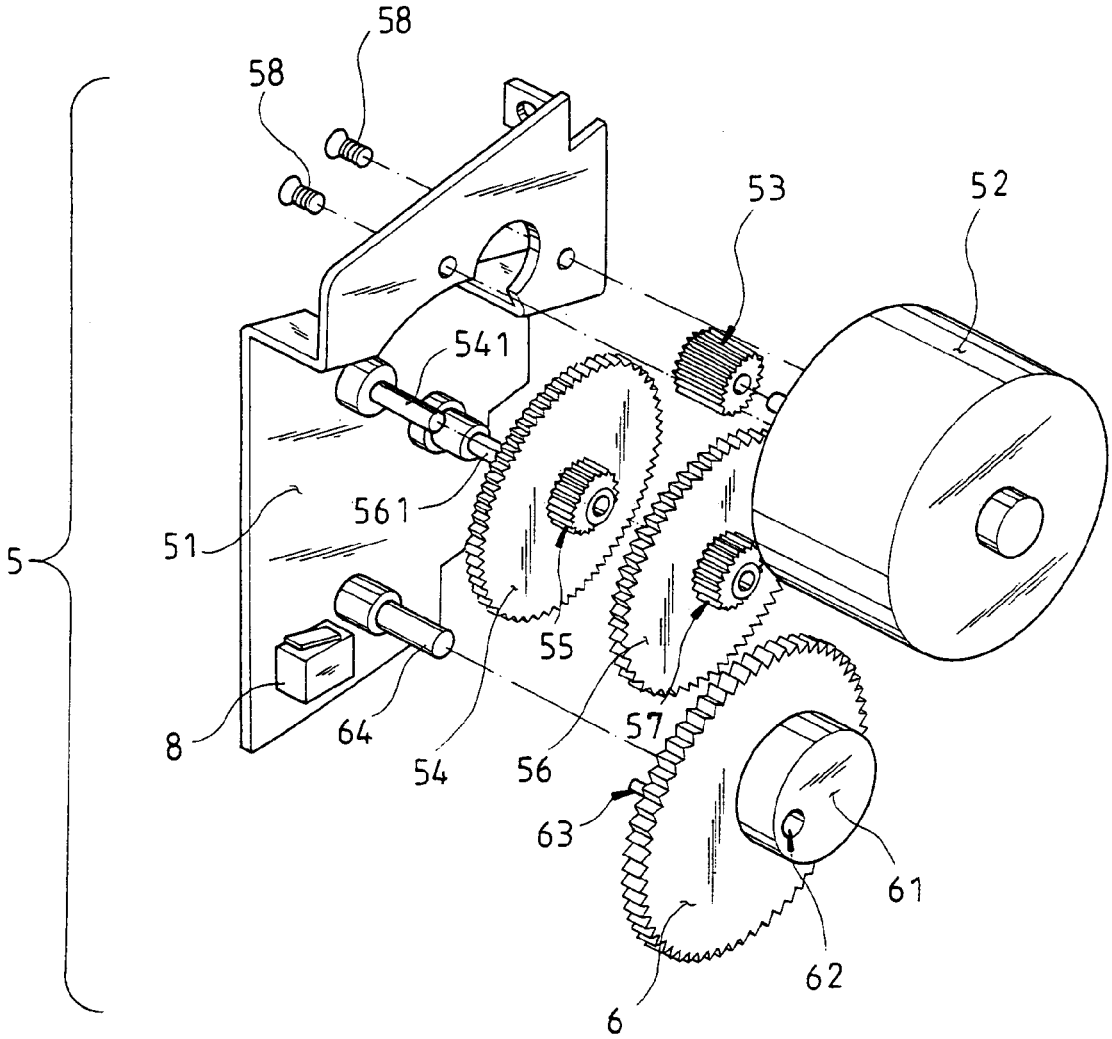
FIG. 6 is a schematic view of a driving device of the present invention.
Figure 7:
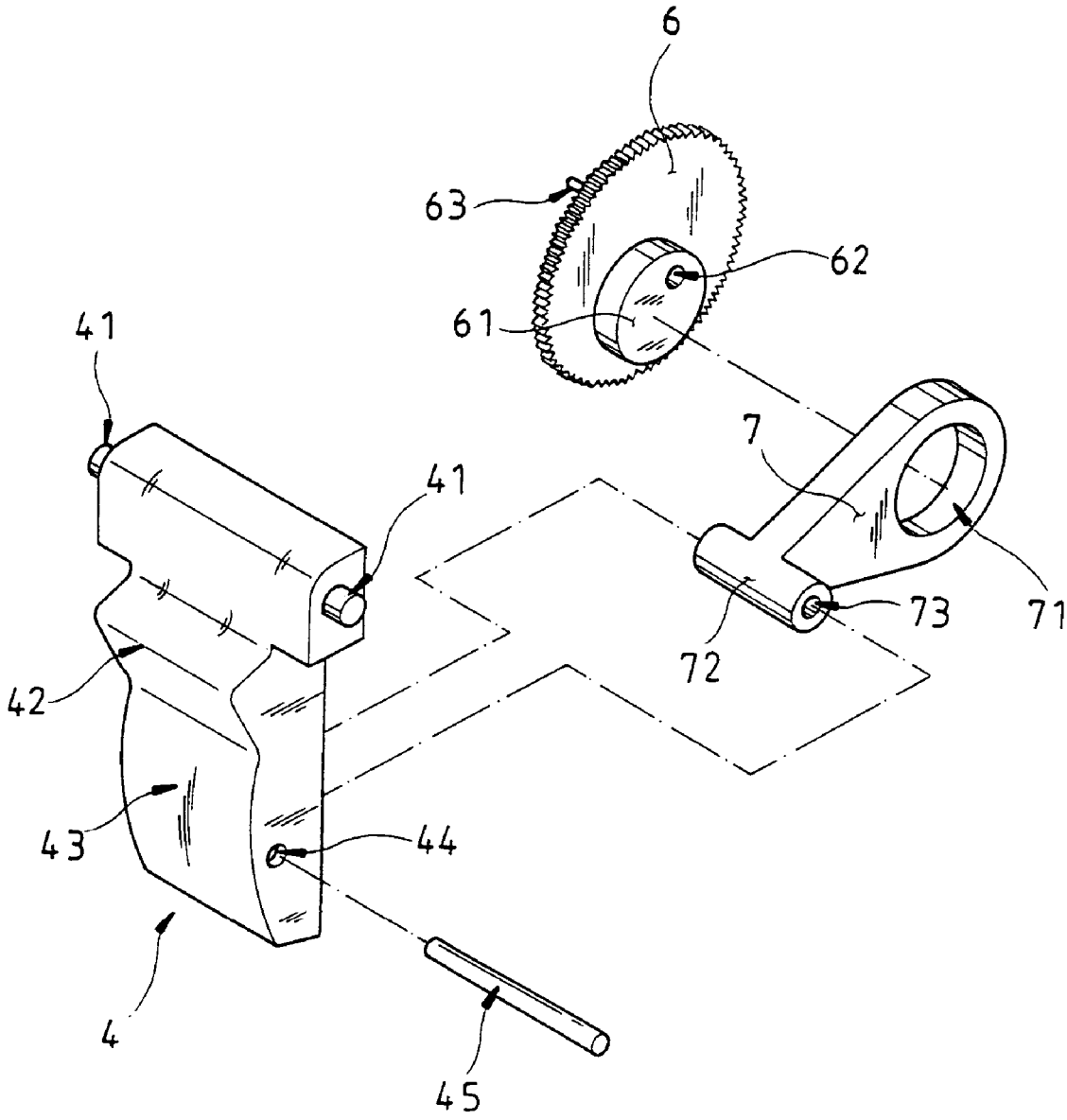
FIG. 7 is a schematic view of a press plate of the present invention.
Figure 8:
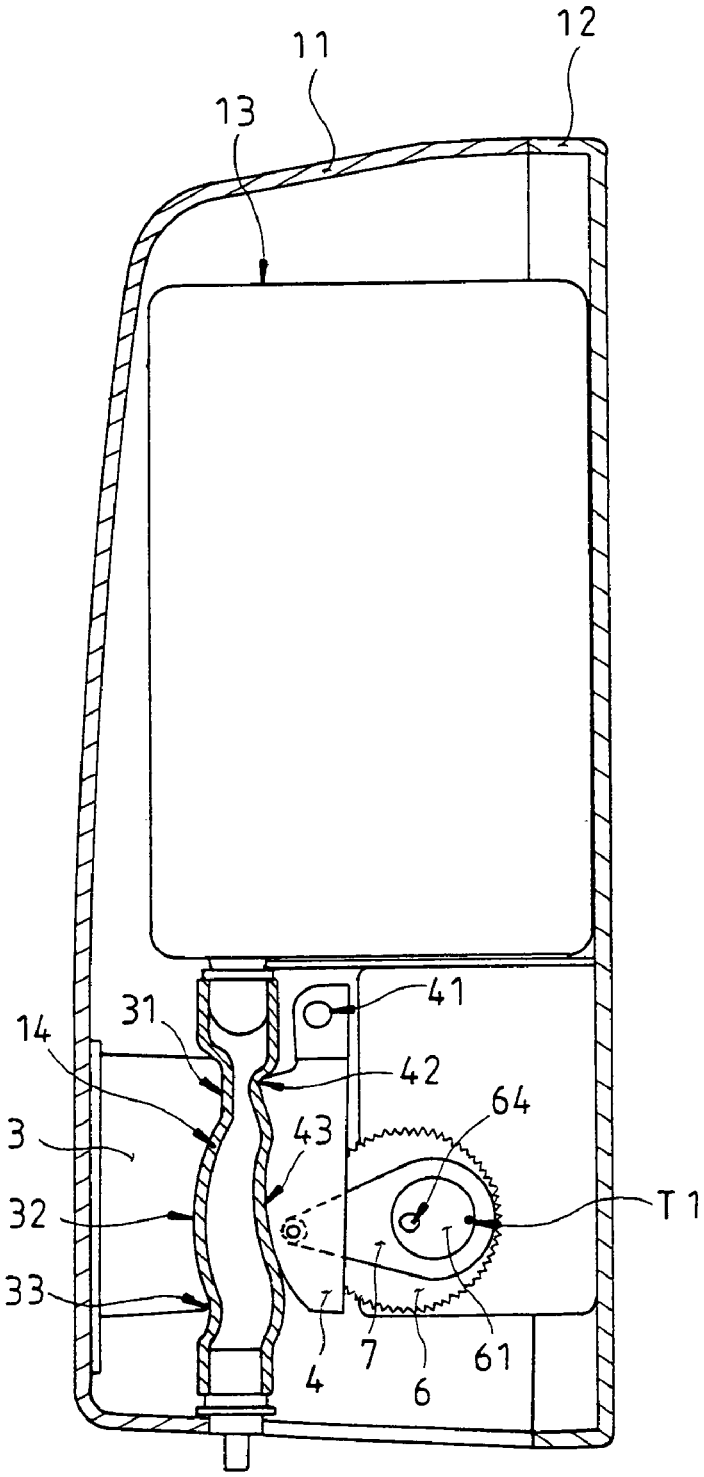
FIGS. 8 to 11 are schematic views of the discharge-recharge cycle of the present invention.

Please refer to FIG. 8, the soap dispensing tube 14 is installed between the rear panel 3 and the press plate 4, and a latch area which is an area where the dispensing tube is pinched off is defined between the latch surface 31 of the rear panel 3 and the back plate 42 of the press plate 4 and keeps an appropriate gap in between, so that the soap dispensing tube 14 is filled up with liquid soap which is in an idle status.

Figure 9:
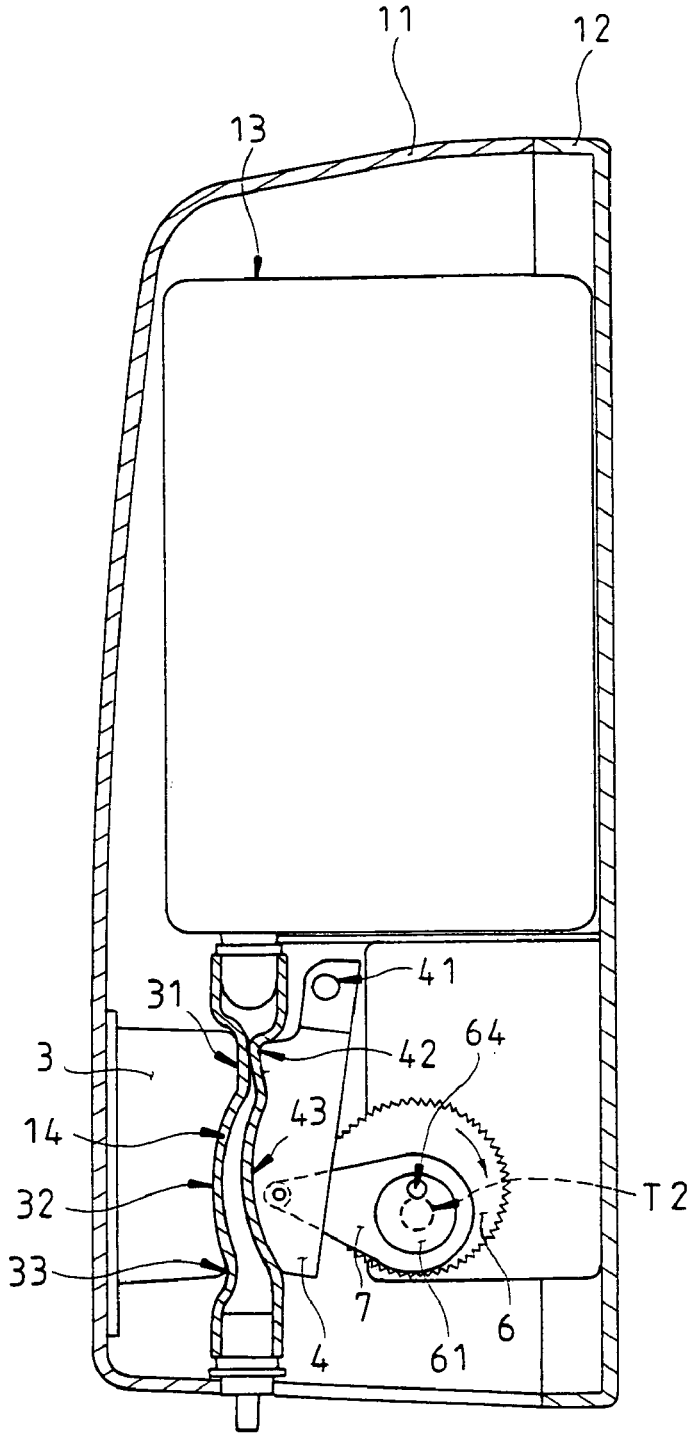
Figure 10:
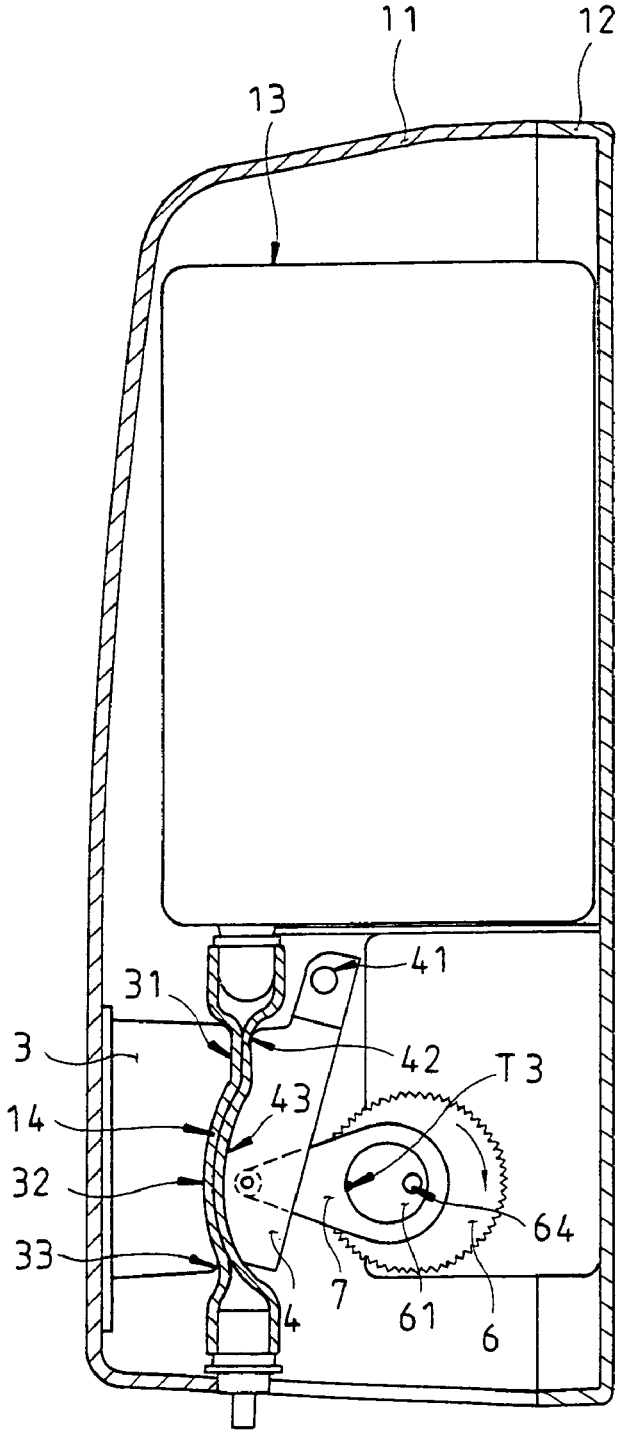
Figure 11:
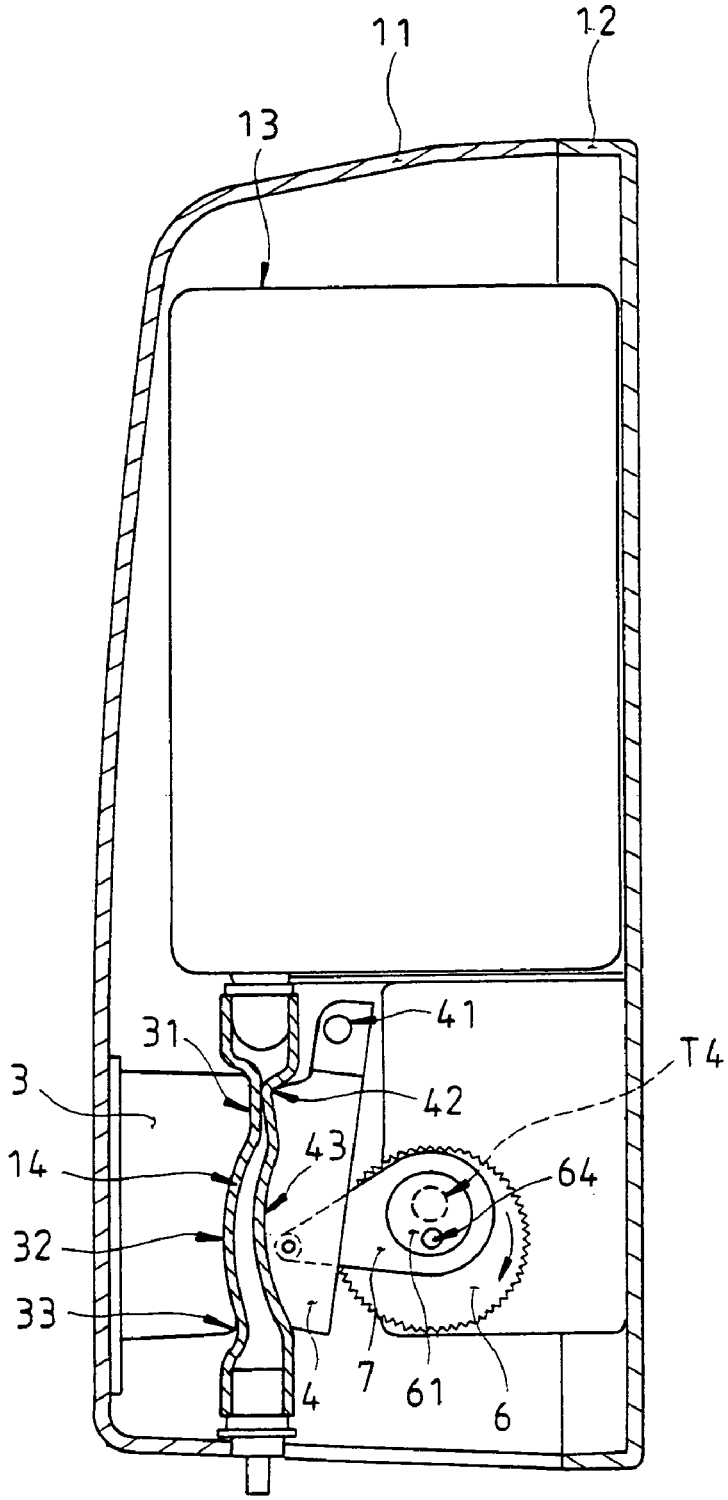

Referring to FIG. 9 for the liquid soap dispenser being activated by its sensor, the driving device drives the driving wheel 6 to rotate clockwise and synchronously drives the eccentric wheel 61 disposed on the driving wheel 6 clockwise, so that the eccentric wheel 61 pushes the link member 7, and an end of the link member 7 axially coupled with the press plate 4 uses the axle 41 of the press plate 4 as the center to be pressed towards the soap dispensing tube 14. By that time, the back plate 42 at the upper section of the press plate 4 and the latch surface 31 at the upper side of the rear panel 3 press the upper end of the soap dispensing tube 14 to define a closed status. Since the back plate 42 is propped onto the top of the latch surface 31, so that the back plate 42 becomes another axle center. The axle 41 and the back plate 42 define dual axle centers. If the press plate 4 continues squeezing the soap dispensing tube 14, the back plate 42 presses and squeezes the upper end of the soap dispensing tube 14 to form a close status and also can maintain the previous pressing and squeezing effect without using additional squeezing force. The curvature and angle of the curved surface 32 of the back plate 3 and the curved surface 43 of the press plate 4 are skillfully designed in a way corresponding to each other to achieve a discharge cycle from the upper end to the lower end of the soap dispensing tube in a fast, power-saving and smooth manner. As shown in FIG. 10, the soap dispensing tube 14 is fully closed and all liquid soap in the soap dispensing tube 14 are squeezed out. If the eccentric wheel 61 continues rotating clockwise to drive the link member 7 and the press plate 4 to move, so that the press plate 4 uses the axle 41 as the center to progressively separate the curved surface 43 from the soap dispensing tube 14 as shown in FIG. 11, and finally the rear panel 3 and the press plate 4 resume their idle status as shown in FIG. 8 to refill liquid soap into the soap dispensing tube 14 and gives a very smooth pressing and squeezing process, From the assembly and implementation of the present invention, we can see the present invention has many improvements and advantages as described as follows.

Figure 12:
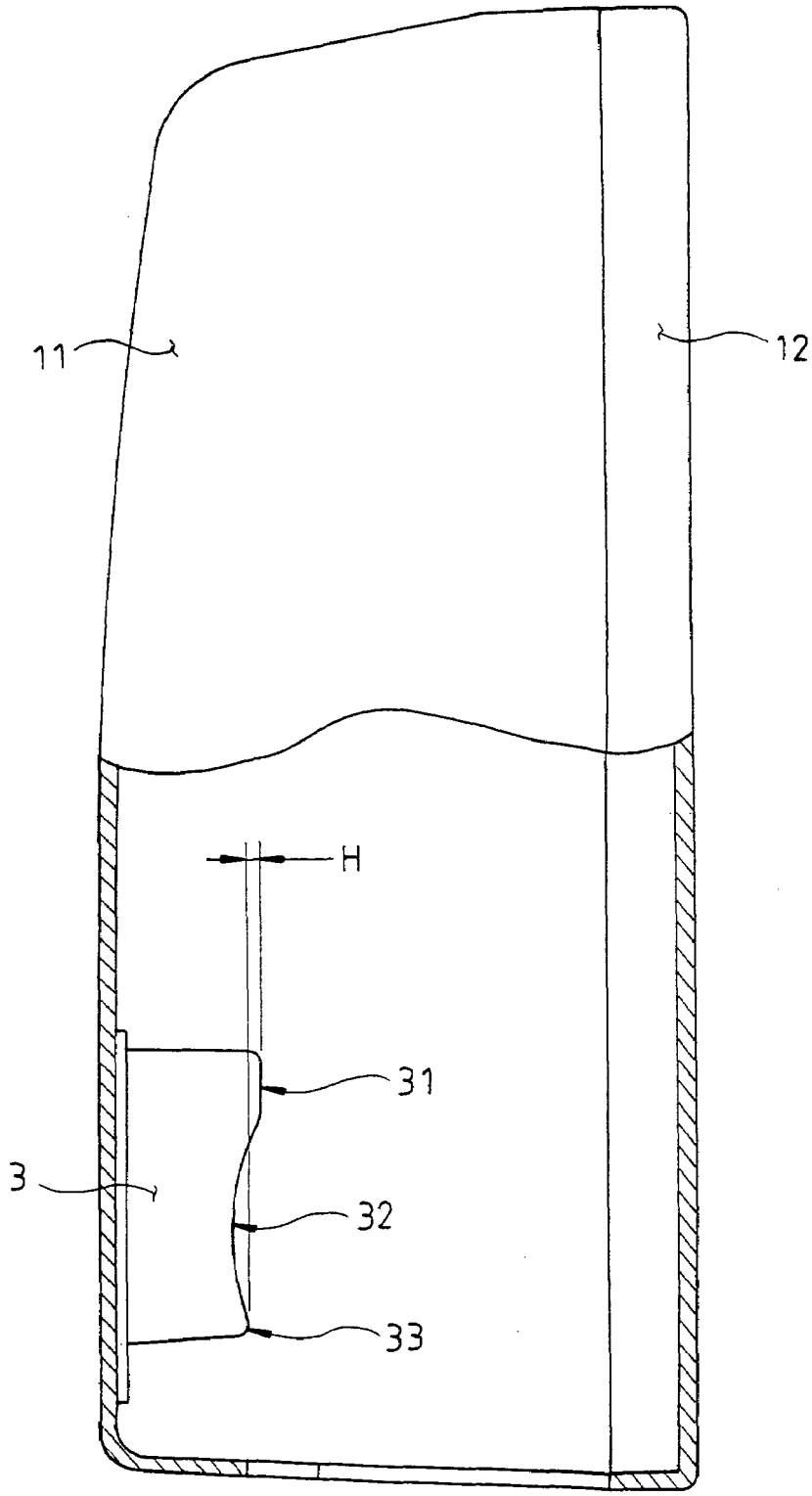
FIG. 12 is a schematic view of a side of a rear panel of the present invention.

The rear panel 3 has a latch surface 31 protruded from the top, and the latch surface 31 has a height difference (H) with the flange 33 at the bottom of the rear panel 3 as shown in FIG. 12. Further, the latch surface 31 at the top side of the rear panel 3 and the back plate 42 at the top side of the press plate 4 can compress the upper end of the soap dispensing tube 14 to form a closed status. Since the back plate 42 is propped onto the top of the latch surface 31, so that the back plate 42 becomes another axle center. The axle 41 and the back plate 42 define dual axle centers. If the press plate 4 continues squeezing the soap dispensing tube 14, the back plate 42 presses and squeezes the upper end of the soap dispensing tube 14 to form a close status and also can maintain the previous pressing and squeezing effect without using additional squeezing force. The curvature and angle of the curved surface 32 of the back plate 3 and the curved surface 43 of the press plate 4 are skillfully designed in a way corresponding to each other to achieve a discharge cycle from the upper end to the lower end of the soap dispensing tube in a fast, power-saving and smooth manner.

The curved surface 32 of the rear panel 3 and the curved surface 43 of the press plate 4 are curved surfaces in contact with each other, and the corresponding curved surfaces are pressed to produce very little friction, and thus the present invention can save power and extend the using life of the battery. In the meantime, the two corresponding curved surfaces are pressed and coupled progressively from the top ends to the bottom ends, so as to fully close the soap dispensing tube 14, and to be capable of squeezing all liquid soap in the soap dispensing tube to the outside.

The link member 7 has an end coupled to an eccentric wheel 61 of the driving wheel 6 and the other end passing through the circular hole 44 of the press plate 4 by the axle rod 45 and passing through the circular hole 73 of the casing pipe 72 of the link member 7 so as to pivotally couple the link member 7 with the press plate 4. The curved surface 32 of the rear panel 3 and the curved surface 43 of the press plate 4 are two curved surfaces are pressed with each other and coupled progressively from the upper end to the lower end. Therefore, the squeezing force produced in a discharge cycle defines a charge-discharge cycle. Referring to FIG. 8, the driving wheel 6 and the eccentric wheel 61 use the branch axle 64 as the axle center. In a discharge cycle, a first action point T1 acts the start point of the discharge routine, which is defined by 0 degree, while the end point of the discharge routine is defined by 360 degrees. The eccentric wheel 61 uses the branch axle 64 as the axle center to rotate to produce a torque, such that a motion having a smooth curved surface contact drives the link member 7. Referring to FIG. 9, if the eccentric wheel 61 rotates 90 degrees clockwise from the start point of a discharge cycle, then the action of the eccentric wheel 61 will no longer be fixed to the original first action point T1 but falls in the neighborhood near the branch axle 64, which is the second action area T2 as shown by the dotted lines in the figure. Therefore, the driving wheel 6 and the eccentric wheel 61 can drive the link member 7 to complete the discharge cycle in a more power-saving fashion. Referring to FIG. 10 again, if the eccentric wheel 61 rotates 180 degrees clockwise, the eccentric wheel 6 uses a third action point T3 to produce a torque to drive the link member 7, so as to fully close the soap dispensing tube 14 and meet the requirement of having a larger squeezing force. Referring to FIG. 11, if the eccentric wheel 61 rotates 270 degrees clockwise, the action position of the eccentric wheel 61 will fall in the neighborhood near the branch axle 64, which is the fourth action area T4 as shown by the dotted lines in the figure. If the eccentric wheel 61 rotates 360 degrees clockwise, the discharge cycle reaches its end point as well as returns to the start point of the cycle, which is an idle status as shown in FIG. 8. With a smaller motor power, the present invention can produce a maximum squeezing force, give a fast and smooth rotation, extend the battery life, and provide the optimal effect by the most economic and efficient discharging cycle.

By the eccentric wheel 61 and the link member 7, the present invention improves over the prior art that only uses a single force applying point as disclosed in U.S. Pat. No. 6,347,724. In the discharge cycle of the prior art, the squeezing force is increased constantly so that the press plate can squeeze the soap dispensing tube. The prior art not only consumes much power, but also has a high failure rate of components. In addition, the squeezing effect is not as good. Unlike the prior art, the present invention has the technical characteristics advantages of the eccentric wheel 61 using the branch axle 64 as the center for its rotation and form a variable mode with the first action point T1, second action area T2, third action point T3 and fourth action area T4. With the curved surface 32 of the back plate 3 and the curved surface 43 of the press plate 4, the most power-saving operating mechanism for a discharge cycle can be accomplished.

In the description above, the driving wheel 6 also can rotate counterclockwise. While the invention has been described by means of specific embodiments, numerous modifications and variations could be made thereto by those skilled in the art without departing from the scope and spirit of the invention set forth in the claims.

In summation of the above description, the present invention not only has innovative improvements on its space configuration, but also maximizes the performance and enhances the performance than the conventional structure and further complies with the patent application requirements.

What is claimed is:

1. An improved automatic soap dispenser structure, comprising:

a casing, being a hollow housing and having a rear panel protruded from the internal bottom of said hollow housing;

a chassis, latching and covering the rear of said casing;

a liquid soap container, being a rectangular box and having a liquid soap bag for storing an appropriate quantity of liquid soap, and having an appropriate flexible soap dispensing tube disposed at the bottom of a side of said liquid soap container and said liquid soap container being disposed at the upper section between said casing and said chassis;

a containing box of a squeeze control box, being a rectangular box and having two partitions therein for partitioning said containing box into three containing spaces, wherein the left and right containing spaces are provided for containing a battery module, and the middle space is provided for containing a press plate, a driving device and a link member, and said two partitions separately include a penetrating circular hole disposed at the top of an external side of said containing box;

a driving device, being engaged to a driving wheel by a motor and a gear wheel module and fixed into the center of said containing box by said fixed plate, so as to drive a link member of said driving wheel to push said press plate; characterized in that:

said rear panel includes a latch surface protruded from its upper section, a slightly recessive curved surface disposed at the middle section and the lower section of said rear panel and a flange disposed at the bottom of said rear panel;

said press plate includes an axle protruded separately from both sides of an end of said plate, a back plate protruded from the upper edge of said press plate, and a slightly protruded curved surface disposed at an external side of the middle and lower sections of said press plate, and a circular hole is passed through the lower section of said press plate, and said press plate includes two axles axially coupled into circular holes of said two partitions of said containing box;

said containing box of said squeeze control box is mounted onto the bottom of said chassis to place said liquid soap container above said containing box, and said soap dispensing tube is latched to an external side of said press plate, such that said soap dispensing tube is installed between said rear panel and said press plate, and said casing and said chassis are coupled to define an improved automatic soap dispenser structure.

2. The improved automatic soap dispenser structure as claimed in claim 1, wherein said rear panel includes a latch surface protruded from its top end, and said latch surface has a height difference with said flange at the bottom of said rear panel, and the protruded height of said latch surface is greater than said flange at the bottom of said rear panel.

3. An improved automatic soap dispenser structure, comprising a casing, a chassis, a liquid soap container and a squeeze control box; wherein:

said casing, being a hollow housing and having a rear panel protruded from the internal bottom of said hollow housing;

said chassis, latching and covering the rear of said casing;

said liquid soap container, being a rectangular box and having a liquid soap bag for storing an appropriate quantity of liquid soap, and having an appropriate flexible soap dispensing tube disposed at the bottom of a side of said liquid soap container and said liquid soap container being disposed at the upper section between said casing and said chassis;

a containing box of said squeeze control box, being a rectangular box and having two partitions therein for partitioning said containing box into three containing spaces, wherein the left and right containing spaces are provided for containing a battery module, and the middle space is provided for containing a press plate, a driving device and a link member, and said two partitions separately include a penetrating circular hole disposed at the top of an external side of said containing box;

a driving device, being engaged to a driving wheel by a motor and a gear wheel module and fixed into the center of said containing box by said fixed plate, so as to drive a link member of said driving wheel to push said press plate;

characterized in that: said driving wheel includes an eccentric wheel protruded from a side and pivotally coupled to a branch axle of said fixed plate by using the circular hole at the center; an end of said link member is passed through said circular hole and said circular hole is pivotally coupled to said eccentric wheel on a side of said driving wheel, and said link member includes a casing pipe disposed at the other end, and said casing pipe includes a circular hole penetrating the center of the casing pipe, and said link member is passed through said circular hole of said press plate by an axle rod and penetrated into said circular hole of said casing pipe of the link member, such that said link member is pivotally coupled with said press plate; and a variable torque is produced during a charge-discharge cycle of said link member and said eccentric wheel, such that said eccentric wheel drives said link member to push said press plate.

* * * * *